United States Patent [19]

Richards

[11] 4,321,132

[45] Mar. 23, 1982

[54] DISTILLATION OF CRUDE OIL

[75] Inventor: George W. Richards, Tulsa, Okla.

[73] Assignee: Combustion Engineering, Inc., Windsor, Conn.

[21] Appl. No.: 149,109

[22] Filed: May 12, 1980

[51] Int. Cl.[3] ..... B01D 3/06; C10G 7/00

[52] U.S. Cl. ..... 208/352; 196/134; 208/353

[58] Field of Search ..... 208/352, 353; 196/100, 196/134

[56] References Cited

U.S. PATENT DOCUMENTS

| | | | |
|---|---|---|---|
| 2,050,847 | 8/1936 | Keith, Jr. | 196/134 |
| 2,093,279 | 9/1937 | Keith, Jr. | 196/134 |
| 3,537,985 | 11/1970 | Mayhue | 208/352 |
| 4,131,538 | 12/1978 | Rose | 208/352 |

*Primary Examiner*—T. M. Tufariello
*Attorney, Agent, or Firm*—Arthur L. Wade

[57] ABSTRACT

An entire crude oil stream is preheated by various sources of heat and brought to final temperature by a furnace. At this highest temperature, the stream is flashed into two portions, the heavier portion used only as a source of sensible heat for conservation. The vaporized fractions have their heat recycled into the crude oil stream and are then fractionated to extract a product of desired boiling range, flash point, and vapor pressure. The fractionation column is heated by the heavier, separated portion of the stream and refluxed by heat exchange with the crude oil stream.

4 Claims, 1 Drawing Figure

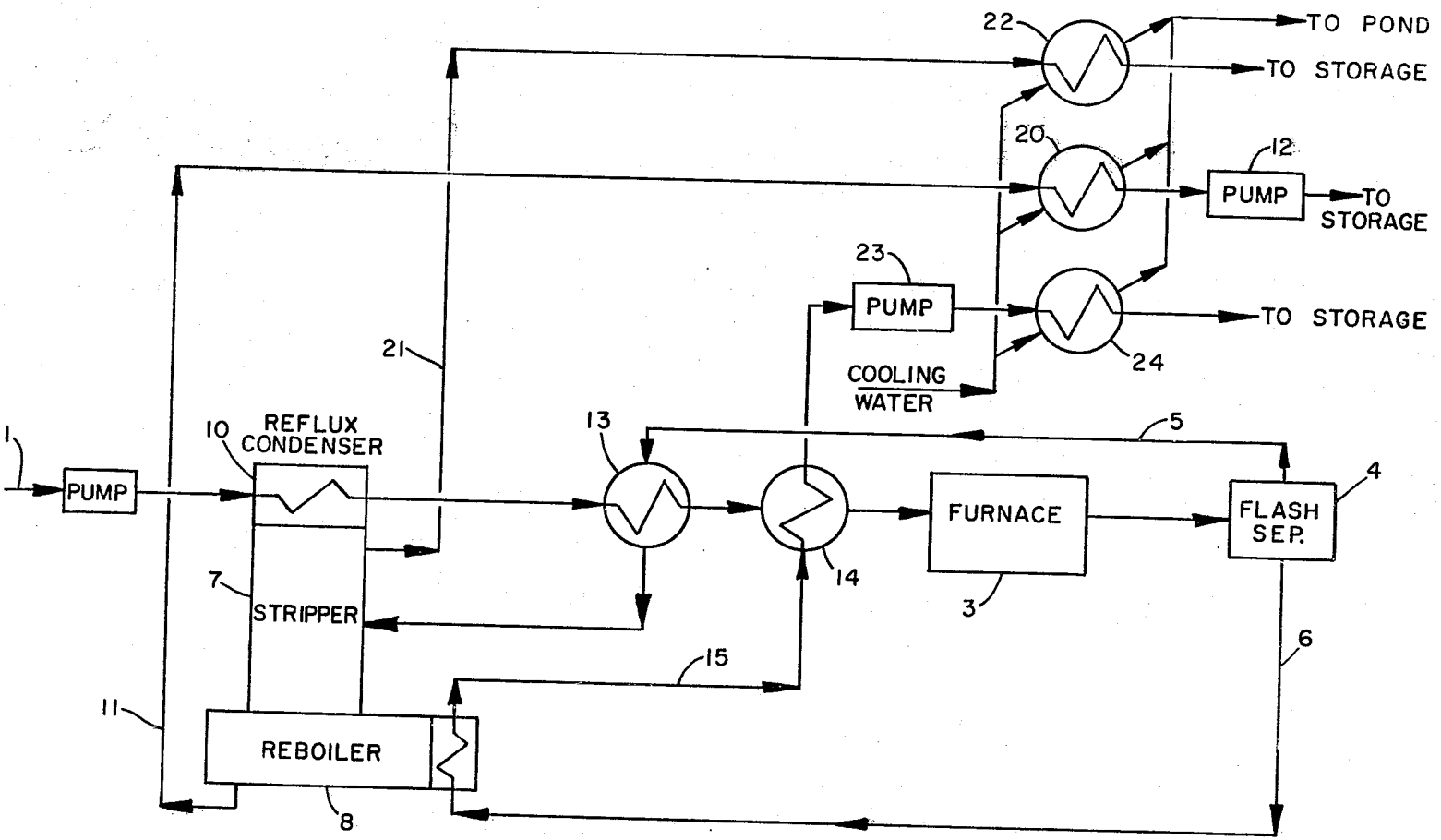
TO POND
TO STORAGE
TO STORAGE
TO STORAGE
PUMP
12
22
20
24
23
PUMP
COOLING WATER
FLASH SEP.
4
6
5
FURNACE
3
14
13
15
21
REFLUX CONDENSER
10
STRIPPER
7
REBOILER
8
11
PUMP
1

DISTILLATION OF CRUDE OIL

TECHNICAL FIELD

The present invention relates to the extraction, or isolation, of a predetermined range of hydrocarbons having selected boiling ranges, flash points, and vapor pressures. More particularly, the invention relates to extracting a cut of product from a crude oil stream by the use of a single heat source.

BACKGROUND ART

It is well known to heat crude oil and inject the stream into a fractionating tower having a side draw with which to extract a liquid product with a specified boiling range, flash point, and vapor pressure. As an example, the specified range of product from the crude oil stream may be that intermediate range entitled "diesel fuel". For analysis, that portion of the crude oil stream heavier than the diesel fuel is entitled "residual". The products lighter than the diesel fuel will be referred to as natural gasoline.

In further refinement of the diesel fuel product drawn from the fractionating tower, a second fractionating tower is provided in which steam stripping is used to closely control the desired boiling range, flash point, and vapor pressure of the diesel fuel as a final product.

It is becoming desirable to shift this relatively crude product separation into the field, closer to the wellhead. When this shift is made, it becomes highly desirable to eliminate the huge fractionation column of refinery practice, the second steam stripping column, and the source of steam. It is acceptable to provide additional equipment if the total capital output can be reduced.

DISCLOSURE OF THE INVENTION

The present invention contemplates a single station at which the crude is heated, followed by a single flash separation stage which will divide the stream into the residual portion of the stream and the lighter products, including the products to be extracted. The invention contemplates indirect heat exchange between the overhead from the flash separation stage with the crude oil stream prior to its heating at the single station. The invention then contemplates a fractionation stage for the cooled and partially condensed overhead with any heat required derived from indirect exchange with the residual from the flash separation. Finally, the invention contemplates indirect heat exchange between the crude oil stream and the overhead natural gasoline from the fractionation step as additional heat conservation within the system.

Other objects, advantages, and features of the invention will become apparent to one skilled in the art upon consideration of the written specification, appended claims and accompanying drawing.

BRIEF DESCRIPTION OF THE DRAWING

The drawing is a schematic of a crude oil treating system in which the present invention is embodied.

BEST MODE FOR CARRYING OUT THE INVENTION

The General Process and System

In a conventional diesel fuel topping plant, crude oil is heated and flowed into a fractionation column where the entire stream of crude oil is distilled to produce a diesel fuel with a specified boiling range, flash point, and vapor pressure. For purposes of the present disclosure, the lightest fractions of crude oil are considered to be butane and propane. Straight-run gasoline is considered to be the next heaviest range of fractions, boiling, roughly, at 200 to 350 F. Next would be naptha, somewhere between a gasoline and kerosine. Next is kerosine, followed by light gas-oil, or diesel fuel. Next would be the heavy gas-oil, vacuum gas-oil, and then the heavy ends which are commonly referred to as the resid. The present invention was conceived out of the desire to obtain a diesel fuel product specified as to boiling range, flash point, and vapor pressure. More specifically, the boiling range is expected to fall between 400 and 700 F. Of course, there are several diesel fuel specifications within this boiling range.

In the conventional diesel fuel topping plant the approach to processing the crude oil to obtain a specified diesel fuel is initiated by heating the entire crude oil stream by various heat exchange arrangements, and then applying additional furnace heat to insure that the stream can then be flashed into a trayed distillation column. The overhead is condensed and a portion of the liquid pumped back into the head of the column as reflux and the desired diesel fuel oil cut is distilled from the entire crude oil stream. The fractions heavier than the diesel fuel oil will descend through the tower and be withdrawn from its bottom. The sensible heat from this heavier material withdrawn from the bottom of the tower is used to preheat the crude oil stream before the application of furnace heat.

This preamble to the disclosure of the invention does not include consideration of the ultimate disposition of the many products drawn from the fractionation column. The present practice is outlined as withdrawing from the first fractionation column a product which contains the diesel fuel fraction and flowing it into a second fractionation column. In this second column, usually called a stripper, readily available refinery steam is used to control the distillation process so that the final diesel fuel withdrawn from this second column is precisely controlled as to its boiling range, flash point, and vapor pressure. In effect, the steam stripping in this second column removes all those ends which would adversely affect the desired specification for the diesel fuel oil cut.

Heat recovery from the discharge at the top of the first fractionation column is limited. The refluxing of the first fractionation column results in the temperature being quite low, in the range of 200 to 300 F. It is the desired practice to recover all of the heat possible from the various outputs of the distillation columns and cycle this heat back into the initial crude oil stream to reduce the furnace load. The present invention offers an improvement in conservation of the heat as ancillary to the basic concept of the invention.

Birth of the present concept was motivated by the desire to simplify the fractionation process when a specific cut is the basic objective in processing the crude oil stream. Suddenly, it was realized that flash separation at the highest temperature of the crude oil stream could avoid the problems of taking all of the fractions below the cut desired into the fractionation process. Implementing this concept resulted in several excellent benefits to the system:

1. The residuum is separated immediately following the furnace heating of the crude oil stream to remove it from the distillation process.

2. The flashed fractions above the residuum have their heat recycled back into the crude oil stream.

3. Fractionation of the condensing vapors from flash separation can be processed without the gas liquid traffic burden of the residuum.

4. The required external pumping arrangement for the reflux in the standard fractionation column is eliminated.

5. Two fractionation columns are not required.

6. The residuum is used in indirectly heating the fractionation column for the distillation of the final product.

The specific Process and System

In the drawing, the entire crude oil stream is brought into the system through conduit 1. Pump 2 represents the power required to draw this crude oil stream from a storage and discharge it into the system in which the present invention is embodied. The entire crude oil stream is brought to its highest temperature by furnace 3. The most significant step of the process then takes place.

Desiring to extract a diesel fuel cut, the entire crude oil stream is brought to about 600 F. and flowed into flash separator 4. At the temperature level established by heater 3, the crude oil stream is divided, basically, into two portions. The first portion, in vapor form, is flowed from the top of separator 4 through conduit 5. The second portion, remaining a fluid, is flowed from the bottom of separator 4 through conduit 6. The ultimately desired diesel fuel oil fractions are included in the first portion. These fractions will be controlled to the desired boiling range, flash point, and vapor pressure in fractionation column 7. The second portion comprises those fractions heavier than the first portion. and will be referred to as the resid, residuum, or residual. The sensible heat of the residuum will be utilized in indirect heat exchange in the reboiler 8 at the bottom of column 7.

Fractionation column 7 is operated with the input from conduit 5, an indirect heat source provided by the residuum of conduit 6, and the refluxing provided by the crude oil stream of conduit 1 passing through the reflux condenser 10. With the temperatures of column 7 held within desired limits at its top and bottom, the ultimately desired diesel fuel flows from the bottom of the column through conduit 11 and is moved to storage by pump 12.

Heat conservation in a system of this type is very important. Furnace, or heater, 3 establishes the highest temperature level for the approach to separator 4. It is vital to economy to cycle all heat possible from the output of separator 4 back into the crude oil stream approaching furnace-heater 3 through conduit 1. As previously disclosed, a portion of this heat is indirectly picked up by the crude oil stream in reflux condenser 10. A significant amount of this heat is recovered from the vaporized portion of conduit 5 in heat exchanger 13. Further, the residuum, or second portion, of conduit 6 is flowed from reboiler 8 through exchanger 14 through conduit 15. All of these heat exchangers, 10, 13, and 14, preheat the crude oil stream prior to its final heating in furnace-heater 3, and, correspondingly, reduce the heat load on this unit 3.

In the process carried out in the system of the drawing, the products are moved to storage. The basic product of process and system is the diesel fuel fractions in conduit 11 which are pumped to storage not shown. On their way to storage, these products are cooled by any convenient means available. Water-cooled heat exchanger 20 represents a convenient means of cooling. The gasoline fractions extracted from column 7 are flowed through conduit 21 and water-cooled heat exchanger 22, on their way to storage, not shown. Finally, the residuum of conduit 15 is pumped by 23 through watercooled heat exchanger 24 to storage. The final disposition and handling of these products is ancillary to that portion of the system and process disclosed which embodies the present invention. A simple, one-stage heating at 3 brings the entire stream to the desired temperature for the basic separation in 4. The residuum portion of the stream is isolated from the distillation, only its sensible heat being used to control the temperature of column 7. The operation of column 7 is then the separation of the diesel fuel components desired, flowing this product from the bottom of column 7 through conduit 11.

From the foregoing, it will be seen that this invention is one well adapted to attain all of the ends and objects hereinabove set forth, together with other advantages which are obvious and inherent to the method and apparatus.

It will be understood that certain features and subcombinations are of utility and may be employed without reference to other features and subcombinations. This is contemplated by and is within the scope of the invention.

As many possible embodiments may be made of the invention without departing from the scope thereof, it is to be understood that all matter herein set forth or shown in the accompanying drawings is to be interpreted in an illustrative and not in a limiting sense.

I claim:

1. The method of distilling a predetermined product from a crude oil stream, including, heating the entire crude oil stream to a predetermined temperature, separating the heated crude oil stream into a vaporized first portion and a liquified second portion, indirectly cooling the first vaporized portion of the crude oil stream with the total crude oil stream prior to the heating of the stream in preparation of the stream for its separation, and distilling the first separated portion of the cooled crude oil stream by (1) indirect heat exchange with the second separated portion of the entire stream, and (2) indirect heat exchange with the entire stream before the entire stream is heated in preparation for the separation of the entire stream into liquid and vapor portions, to produce from the vapor portion a product of fractions of predetermined boiling range and flash point and vapor pressure.

2. The process of claim 1, in which, the second separated portion of the crude oil stream is indirectly heat-exchanged with the entire crude oil stream after the second separated portion has indirectly contributed heat to the distillation of the first vapor portion and prior to the heating of the crude oil stream in preparation for its separation.

3. A crude oil distillation system, including, a source of crude oil from which a selected range of hydrocarbon fractions is to be extracted, a furnace connected to the supply of crude oil for heating the entire stream of crude oil to a predetermined temperature, a separator connected to the furnace to receive the entire heated crude oil stream and in which a first portion of the crude oil is vaporized at the predetermined temperature established by the furnace and a second portion of the crude oil is discharged in liquid form, a first heat exchanger connected to the separator to receive the vaporized first portion of the crude oil from the separator and heat the entire crude oil stream prior to the heating of the entire stream by the furnace, and a distillation column connected (1) to the first heat exchanger to receive the first vaporized portion of crude oil for distillation, (2) by the lower end of the column of the separator to receive the second liquid portion of the crude oil stream for indirect heating of the column by the separated liquid portion, and (3) by the upper end of the column, to receive the entire crude oil stream for indirect cooling of the upper end by the entire crude oil stream prior to the heating of the entire crude oil stream in preparation for its separation, whereby the temperature of the column is controlled by the indirect heating and the indirect cooling to produce predetermined fractions of the crude oil from the first portion which fractions have a predetermined boiling range and flash point and vapor pressure.

4. The system of claim 3, including, a second heat exchanger connected to the entire crude oil stream prior to the heating of the entire crude oil stream by the furnace in which the second liquid portion of crude oil having heated the lower end of the distillation column is indirectly cooled by the entire crude oil stream.

* * * * *